US006171227B1

(12) United States Patent
Spatafora

(10) Patent No.: US 6,171,227 B1
(45) Date of Patent: Jan. 9, 2001

(54) EMBOSSING UNIT

(75) Inventor: Mario Spatafora, Bologna (IT)

(73) Assignee: G.D Societá per Azioni, Bologna (IT)

( * ) Notice: Under 35 U.S.C. 154(b), the term of this patent shall be extended for 0 days.

(21) Appl. No.: 09/286,030

(22) Filed: Apr. 5, 1999

(30) Foreign Application Priority Data

Apr. 8, 1998 (IT) ..... BO98A0231

(51) Int. Cl.[7] ..... B31B 1/36
(52) U.S. Cl. ..... 493/403; 493/60; 493/66
(58) Field of Search ..... 493/403, 64, 60, 493/66, 241, 464, 967, 340, 353; 100/169, 168

(56) References Cited

U.S. PATENT DOCUMENTS

| | | | | |
|---|---|---|---|---|
| 3,572,570 | | 3/1971 | Mortensen | 226/177 |
| 3,598,457 | | 8/1971 | Sejeck | 308/22 |
| 3,669,014 | * | 6/1972 | Spaw et al. . | |
| 3,956,957 | * | 5/1976 | Corse | 493/60 |
| 4,618,342 | * | 10/1986 | Borell | 493/60 |
| 4,641,575 | * | 2/1987 | Cavagna | 493/442 |
| 5,007,271 | | 4/1991 | Boegli | 72/196 |
| 5,183,672 | * | 2/1993 | Fetterhoff et al. | 493/60 |
| 5,220,858 | * | 6/1993 | Allen et al. | 493/403 |
| 5,261,209 | * | 11/1993 | Focke et al. | 493/911 |
| 5,261,324 | | 11/1993 | Jakobs | 100/158 |
| 5,392,702 | * | 2/1995 | Suzuki | 100/168 |
| 5,598,774 | | 2/1997 | Boegli | 100/170 |
| 5,782,177 | * | 7/1998 | Rindfleisch | 100/168 |
| 5,913,765 | * | 6/1999 | Burgess et al. | 493/403 |

* cited by examiner

*Primary Examiner*—Eugene Kim
(74) *Attorney, Agent, or Firm*—Ladas and Parry

(57) ABSTRACT

An embossing unit having a frame supporting a pair of embossing rollers by means of respective supports, a first of which is integral with the frame, and a second of which is connected to the frame by a spherical connection and is pushed towards the other support by a force generated by a pair of electromagnets.

20 Claims, 2 Drawing Sheets

EMBOSSING UNIT

FIELD OF THE INVENTION

The present invention relates to an embossing unit.

In particular, the present invention relates to an embossing unit which may be used to advantage for processing strips of foil or similar material on automatic cigarette packing machines.

BACKGROUND OF THE INVENTION

European Patent No. 139,066 relates to a foil embossing unit comprising a fixed frame supporting a pair of embossing rollers cooperating with each other and mounted for rotation on respective pairs of bearings. One of the rollers is a drive roller and therefore connected to a motor, while the other is driven by the drive roller and therefore free to rotate about a respective axis. The drive-roller bearings are fixed with respect to the frame, whereas the driven-roller bearings are movable with respect to the frame, substantially independently of each other and in opposition to elastic means, in a direction perpendicular to the traveling direction of the foil between the two rollers.

The above device has several drawbacks, due to automatic in-service adjustment of the two roller axis positions being limited to only one direction, which means the two rollers must be positioned extremely accurately, and therefore at great cost, when setting up the unit, and the set position of the rollers checked periodically. Moreover, in the event, as frequently happens, of the rollers shifting slightly from the set positions, the above limitation results in increased vibration, uneven wear of the rollers, and possibly also embossing defects.

One solution to the above drawbacks is proposed in European Patent Application No. 686,782, which relates to an embossing unit similar to the one described in European Patent No. 139,066, except that the driven-roller bearings are movable with respect to the frame, substantially independently of each other and in opposition to elastic means, in a first direction and a second direction respectively perpendicular and parallel to the traveling direction of the foil between the two rollers.

European Patent Application No. 686,782 enables automatic in-service adjustment of the two roller axis positions in two perpendicular directions, but only at the expense of a mechanically complex and therefore high-cost device, which, by failing to also provide for automatic adjustment along the roller axes, only partially solves the aforementioned drawbacks.

SUMMARY OF THE INVENTION

It is an object of the present invention to provide an embossing unit designed to eliminate the aforementioned drawbacks, and which, in particular, is straightforward and cheap to produce.

According to the present invention, there is provided an embossing unit comprising a frame; a first and a second embossing roller; a first support supporting in rotary manner said first embossing roller and integral with said frame; and at least one second support supporting in rotary manner said second embossing roller; characterized by comprising a mechanical connection with three degrees of freedom for connecting said second embossing roller to said frame.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
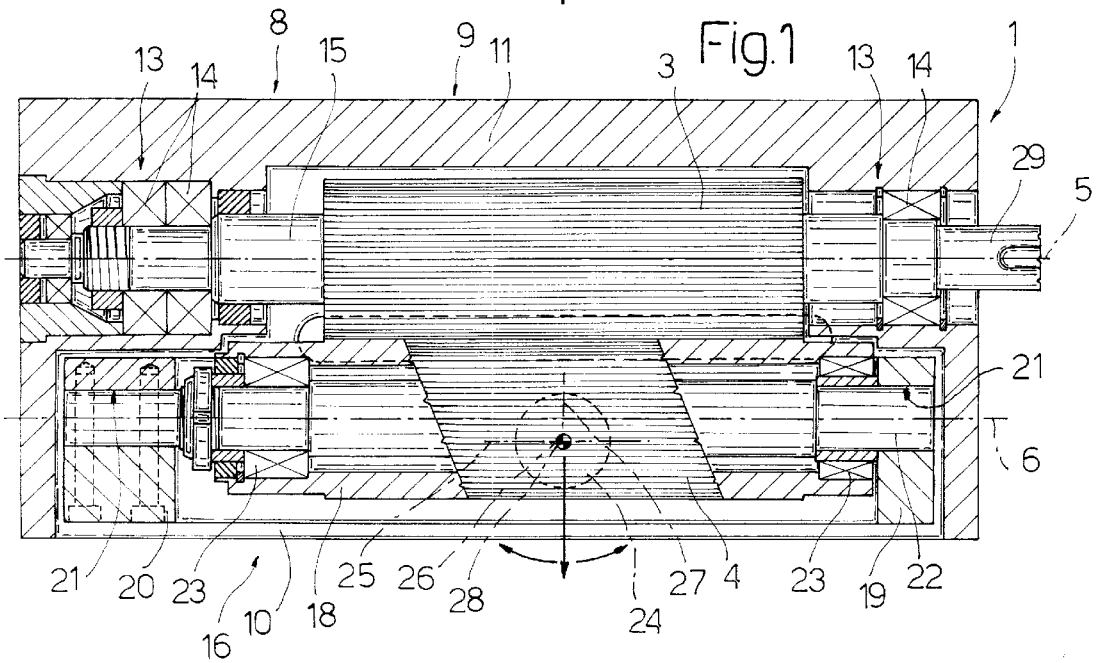
FIG. 1 shows a section, with parts removed for clarity, of a preferred embodiment of the unit according to the present invention.

Numeral 1 in FIG. 1 indicates as a whole a unit for embossing strip material 2 typically comprising a strip of foil or similar material, which is embossed between a known roller 3 and a known roller 4 cooperating mutually and rotating about respective substantially parallel, horizontal axes 5 and 6 lying in the FIG. 1 plane.

The respective lateral surfaces of embossing rollers 3 and 4 comprise a number of conical teeth 7 (FIG. 3) which mesh mutually to emboss strip 2.

Figure 2:
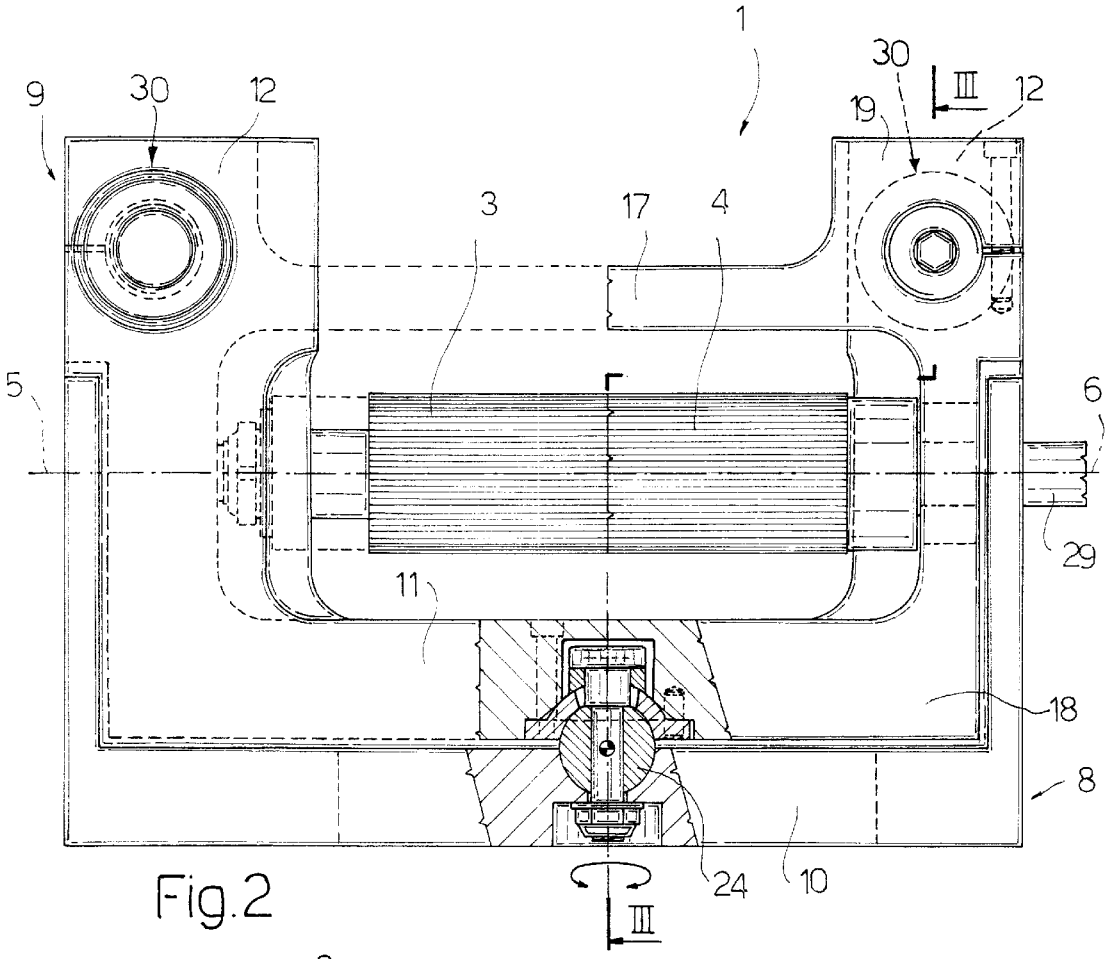
FIG. 2 shows a partly sectioned front view, with parts removed for clarity, of the FIG. 1 unit.

Unit 1 comprises a substantially L-shaped frame 8 in turn comprising a base 9 lying in a plane perpendicular to the plane defined by axes 5 and 6, and a shoulder 10 perpendicular to base 9 and to the FIG. 2 plane. More specifically, base 9 is substantially U-shaped, and comprises a central cross member 11 fitted integrally with shoulder 10; and two arms 12 substantially perpendicular to cross member 11.

Unit 1 also comprises a support 13 defined by a pair of bearings 14, which are housed inside respective holes formed through arms 12 of frame 8, are coaxial with axis 5, and support a rotary shaft 15 fitted with the drive roller 3.

Unit 1 also comprises a support 16 substantially in the form of a rectangular frame comprising two cross members 17 and 18 parallel to each other and to axes 5 and 6 and connected to each other by two arms 19 and 20. Support 16 is fitted to frame 8 so that cross member 18 lies within the dihedron defined by cross member 11 and by shoulder 10; and arms 19 and 20 have two holes 21 coaxial with axis 6 and housing respective opposite ends of a shaft 22 locked with respect to support 16 and supporting roller 4 in rotary manner via the interposition of bearings 23.

Support 16 is connected to frame 8 by a spherical connection 24 interposed between shoulder 10 and a central portion of cross member 18, so that support 16 is substantially free to oscillate about three axes 25, 26, 27 perpendicular to one another and extending through a single fixed point 28 facing a central portion of the driven roller 4. More specifically, axis 25 is parallel to axes 5 and 6; axis 26 is parallel to the traveling direction of strip 2; and axis 27. is perpendicular to axis 25 and to the traveling direction of strip 2.

One end 29 of shaft 15 of drive roller 3 projects outwards of respective arm 12 of frame 8, and is connected angularly to a known drive device (not shown) for rotating shaft 15 continuously about axis 5.

Figure 3:
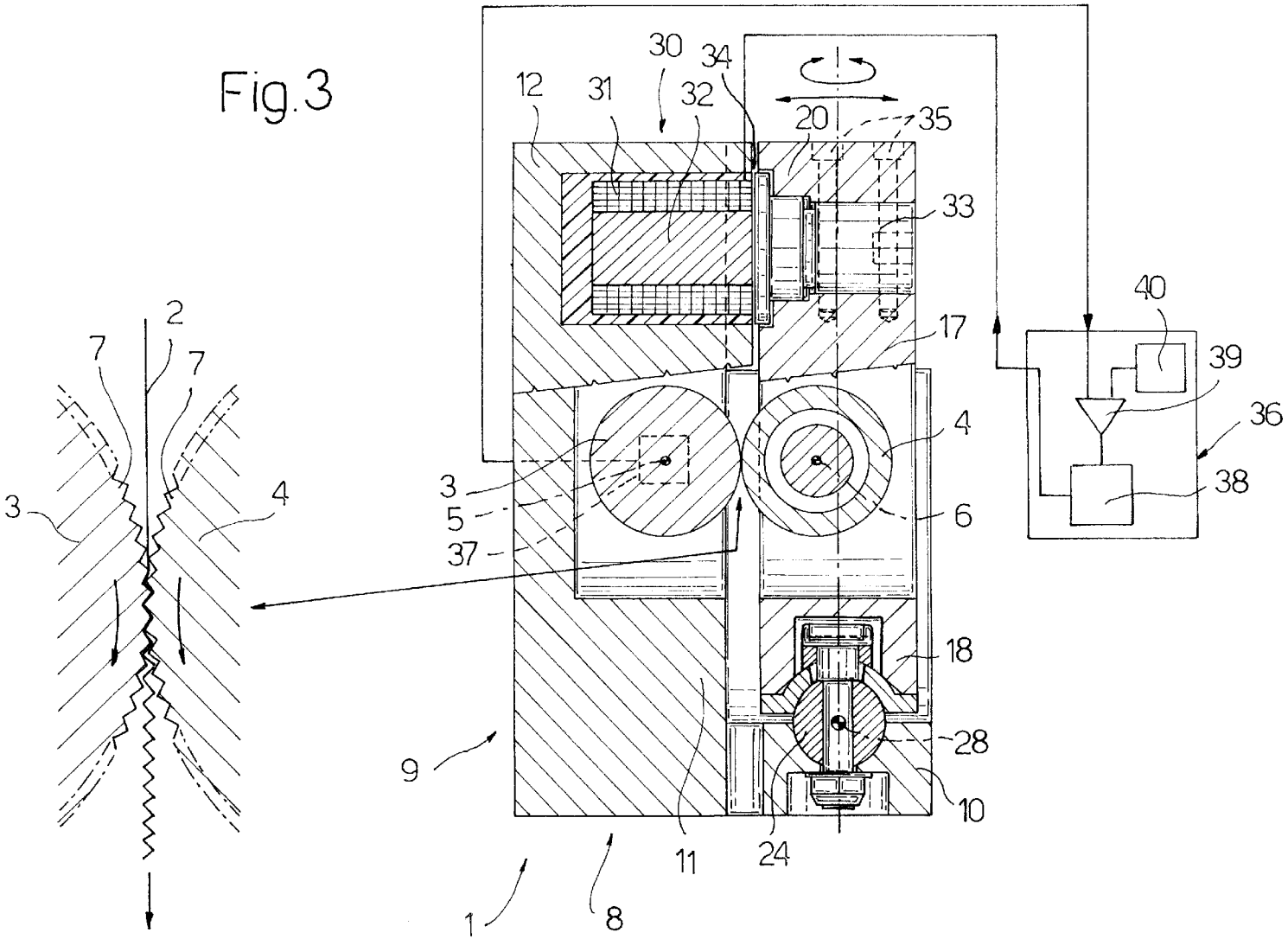
FIG. 3 shows a section along line III—III in FIG. 2.

As shown more clearly in FIG. 3, frame 8 also supports a pair of electromagnets 30 (only one shown in FIG. 3), each of which (FIG. 2) is fitted through an end portion of a respective arm 12 opposite the end portion connected to cross member 11, and each comprises a coil 31 wound about a central core 32 of ferromagnetic material extending parallel to axis 27. Support 16 carries a pair of bodies 33 of ferromagnetic material (only one shown in FIG. 3), each of which is fitted through a respective arm 19, 20, is positioned facing and substantially coaxial with a corresponding electromagnet 30, and defines with electromagnet 30 a respective gap 34 of given width.

By means of screws 35, each body 33 is fittable to respective arm 19, 20 in an axially adjustable position with respect to support 16 so as to adjust the width of gap 34.

Embossing unit 1 also comprises a control unit 36 (shown schematically in FIG. 3); and a pair of force sensors, typically load cells, 37 (only one shown schematically in FIG. 3), each of which is connected to control unit 36 and is preferably interposed between a respective bearing 14 and frame 8 to instantaneously detect the intensity of the force exerted by each bearing 14 on frame 8, and hence the compression exchanged between rollers 3 and 4.

As shown schematically in FIG. 3, for each electromagnet 30, control unit 36 comprises a supply device 38 (only one shown in FIG. 3) for supplying respective coil 31 with direct or alternating current of variable intensity. Each supply device 38 is controlled by the output of a respective comparator 39 (only one shown in FIG. 3) which controls device 38 to instantaneously zero the difference between the force value detected by respective sensor 37 and a reference value generated by a respective device 40 (only one shown in FIG. 3).

Operation of embossing unit 1 will now be described with particular reference to FIG. 3.

In actual use, said drive device (not shown) rotates drive roller 3, which in turn rotates driven roller 4; and, upon embossing rollers 3 and 4 reaching nominal rotation speed, a known supply unit (not shown) feeds strip 2 of foil between rollers 3 and 4.

The ability of support 16 to oscillate about axes 25, 26 and 27 enables roller 4, in use, to adjust its position automatically with respect to the fixed position of roller 3, so that any inaccuracy in the meshing of teeth 7 is corrected automatically.

When embossing foil strip 2, the force exerted by each bearing 14 on frame 8 is maintained equal at all times to a respective reference value generated by device 40. The two bearings 14 may have the same or different reference values. Normally, two different reference values are used when feeding strip 2 between and in a noncentered position with respect to rollers 3 and 4.

In an alternative embodiment, said reference values are generated by device 40 according to the type of strip 2, the feed position of strip 2, and the rotation speed of rollers 3 and 4.

In a further embodiment not shown, embossing unit 1 comprises a pair of supports 16, each of which carries a respective bearing 23 of roller 4 and is connected to frame 8 by a respective spherical connection, so that the position of each bearing 23 may be automatically adjusted partly independently of the position of the other bearing 23.

In yet a further embodiment not shown, support 16 is pushed towards frame 8 by elastic or pneumatic push means connected to, and so enabling automatic adjustment of the position of, support 16.

The spherical connection 24 shown in FIG. 1 may be replaced by any other type of connection enabling support 16 to oscillate freely about axes 25, 26 and 27.

What is claimed is:

1. An embossing unit comprising a frame (8); a first (3) and a second (4) embossing roller; a first support (13) supporting in rotary manner said first embossing roller (3) and integral with said frame (8); and an second support (16) supporting in rotary manner said second embossing roller (4); said first embossing roller (3) being a drive roller; said second embossing roller (4) being a driven roller; said first and second embossing rollers (3, 4) having respective mutually meshing embossing profiles (7); a mechanical connection (24) having three degrees of freedom interposed between said frame and said support for connecting said second embossing roller (4) to said frame (8) to provide adjustment with said three degrees of freedom of said second driven embossing roller relative to said first drive embossing roller to maintain the meshing of said embossing profiles.

2. A unit as claimed in claim 1, wherein said mechanical connection comprises a spherical connection.

3. A unit as claimed in claim 2, wherein in that said spherical connection enables said second support (16) to oscillate about three axes (25, 26, 27) perpendicular to one another and extending through a single fixed point (28) facing a central portion of said second embossing roller (4).

4. A unit as claimed in claim 2, comprising magnetic interacting means (30, 33, 35) for generating a magnetic force of attraction between said second support (16) and said frame (8).

5. A unit as claimed in claim 4, wherein that said magnetic interacting means (30, 33, 35) comprise a pair of electromagnets (30) located on said frame (8) symmetrically with respect to said spherical connection (24).

6. A unit as claimed in claim 5, wherein that said magnetic interacting means (30, 33, 35) further comprises pair of bodies (33) of ferromagnetic material, each located in said second support (16) and facing a corresponding electromagnet (30) in said pair of electromagnets (30).

7. A unit as claimed in claim 6, characterized in that each said electromagnet (30) and respective body (33) of ferromagnetic material define a gap (34) of a given width; said magnetic interacting means (30, 33, 35) comprising adjusting means (35) for adjusting said given width by adjusting the position of the respective said body (33) of ferromagnetic material with respect to said second support (16).

8. A unit as claimed in claim 4, further comprising control means (36) connected to said magnetic interacting means (30, 33, 35) to regulate the intensity of said magnetic force of attraction.

9. A unit as claimed in claim 8, further comprising at least one sensor (37) for detecting, in use, the value of the force of interaction between said first and second embossing rollers (3, 4); said sensor (37) being connected to said control means (36).

10. An embossing unit comprising a frame (8); a first (3) and a second (4) embossing roller; a first support (13) supporting in rotary manner said first embossing roller (3) and integral with said frame (8); and at least one second support (16) supporting in rotary manner said second embossing roller (4); a mechanical connection (24) having three degrees of freedom connecting said second embossing roller (4) to said frame (8); said mechanical connection comprising a spherical connection, which enables said second support (16) to oscillate about three axes (25, 26, 27) perpendicular to one another and extending through a single fixed point (28) facing a central portion of said second embossing roller (4).

11. A unit as claimed in claim 10, wherein said first embossing roller (3) is a drive roller, and said second embossing roller (4) is a driven roller; said first and second embossing rollers (3, 4) having respective mutually meshing embossing profiles (7).

12. A unit as claimed in claim 10, further comprising magnetic interacting means (30, 33, 35) for generating a magnetic force of attraction between said second support (16) and said frame (8).

13. A unit as claimed in claim 12, wherein said magnetic interacting means (30, 33, 35) comprises a pair of electromagnets (30) located on said frame (8) symmetrically with respect to said spherical connection.

14. A unit as claimed in claim 13, wherein said magnetic interacting means (30, 33, 35) further comprises a pair of bodies (33) of ferromagnetic material, each located in said second support (16) and facing a corresponding electromagnet (30) in said pair of electromagnets (30).

15. A unit as claimed in claim 14, wherein each electromagnet (30) and respective body (33) of ferromagnetic material define a gap (34) of a given width; said magnetic interacting means (30, 33, 35) comprising adjusting means (35) for adjusting said given width by adjusting the position of the respective said body (33) of ferromagnetic material with respect to said second support (16).

16. A unit as claimed in claim 12, further comprising control means (36) connected to said magnetic interacting means (30, 33, 35) to regulate the intensity of said magnetic force of attraction.

17. A unit as claimed in claim 16, further comprising at least one sensor (37) for detecting, in use, the value of the force of interaction between said first and second embossing rollers (3, 4); said sensor (37) being connected to said control means (36).

18. An embossing unit comprising a frame (8); a first (3) and a second (4) embossing roller; a first support 913) supporting in rotary manner said first embossing roller (3) and integral with said frame (8); and at least one second support (16) supporting in rotary manner said second embossing roller (4); a mechanical connection (24) having three degrees of freedom connecting said second embossing roller (4) to said frame (8) and a magnetic interacting means (30, 33, 35) for generating a magnetic force of attraction between said second support (16) and said frame (8), said magnetic interacting means (30, 33, 35) further comprising a pair of bodies (33) of ferromagnetic material, each located in said second support (16) and facing a corresponding electromagnet (30) in said pair of electromagnets (30); each electromagnet (30 and respective body (33) of ferromagnetic material defining a gap (34) of a given width; said magnetic interacting means (30, 33, 35) comprising adjusting means (35) for adjusting said given width by adjusting the position of the respective said body (33) of ferromagnetic material with respect to said second support (16).

19. A unit as claimed in claim 18, further comprising control means (36) connected to said magnetic interacting means (30, 33, 35) to regulate the intensity of said magnetic force of attraction.

20. A unit as claimed in claim 19, further comprising at least one sensor (37) for detecting, in use, the value of the force of interaction between said first and second embossing rollers (3, 4); said sensor (37) being connected to said control means (36).

* * * * *